US011022050B2

(12) United States Patent
Schultz et al.

(10) Patent No.: US 11,022,050 B2
(45) Date of Patent: Jun. 1, 2021

(54) AUTOMATIC ENGINE BRAKE CONTROL SYSTEMS AND METHODS

(71) Applicant: CUMMINS INC., Columbus, IN (US)

(72) Inventors: Ryan E. Schultz, Columbus, IN (US); Anthony Kyle Perfetto, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/124,923

(22) Filed: Sep. 7, 2018

(65) Prior Publication Data

US 2019/0178167 A1 Jun. 13, 2019

Related U.S. Application Data

(60) Provisional application No. 62/595,984, filed on Dec. 7, 2017.

(51) Int. Cl.

| | |
|---|---|
| ***F02D 13/04*** | (2006.01) |
| ***F02D 41/12*** | (2006.01) |
| ***F02D 31/00*** | (2006.01) |
| ***F02D 29/02*** | (2006.01) |

(52) U.S. Cl.

CPC ..... *F02D 13/04* (2013.01); *F02D 29/02* (2013.01); *F02D 31/009* (2013.01); *F02D 41/123* (2013.01); *F02D 2200/101* (2013.01); *F02D 2200/501* (2013.01); *F02D 2200/702* (2013.01)

(58) Field of Classification Search

CPC ..... F02D 9/06; F02D 13/04; F02D 31/009; F02D 41/12; F02D 41/123

USPC ..... 701/70, 110, 112; 123/320–323, 123/330–335

See application file for complete search history.

(56) References Cited

U.S. PATENT DOCUMENTS

| | | | | | |
|---|---|---|---|---|---|
| 3,931,870 | A * | 1/1976 | Memmer | B60T 1/087 | 188/296 |
| 4,062,332 | A * | 12/1977 | Perr | F02D 9/06 | 123/323 |
| 5,445,128 | A * | 8/1995 | Letang | B60K 31/045 | 123/436 |
| 5,634,446 | A * | 6/1997 | Rauznitz | B60K 31/00 | 123/322 |
| 5,967,115 | A * | 10/1999 | Konopka | F01L 13/06 | 123/322 |

(Continued)

FOREIGN PATENT DOCUMENTS

| | | | |
|---|---|---|---|
| JP | 63080031 | A * | 4/1988 |
| WO | 2016048359 | A1 | 3/2016 |

*Primary Examiner* — John M Zaleskas

(74) *Attorney, Agent, or Firm* — Faegre Drinker Biddle & Reath LLP

(57) ABSTRACT

A system is provided for controlling operation of an engine brake system of an engine in a vehicle. The system includes a controller having an over-speed condition detection unit and an operation mode transition unit. The over-speed condition detection unit is configured to detect an over-speed condition based on a current engine speed and a fuel cut limit speed, the fuel cut limit speed being a predetermined engine speed at which fuel supplied to the engine is suspended. The operation mode transition unit is configured to control the operation of the engine brake system by transitioning the controller between a plurality of brake operation modes based on at least one transition parameter.

20 Claims, 3 Drawing Sheets

(56) References Cited

U.S. PATENT DOCUMENTS 6,330,873 B1 * 12/2001 Letang ..... B60K 31/045 123/322
6,349,253 B1 * 2/2002 Bellinger ..... B60W 10/06 477/115
6,470,851 B1 * 10/2002 DeGroot ..... F01L 13/06 123/198 DB
6,530,862 B2 * 3/2003 Kolmanovsky ..... F02D 13/04 477/117
6,652,414 B1 * 11/2003 Banks, III ..... F01L 13/06 123/323
7,565,896 B1 * 7/2009 Yang ..... F02D 13/0207 123/321
9,291,107 B2 3/2016 Ross et al.
2001/0016795 A1 * 8/2001 Bellinger ..... B60W 10/06 701/53
2002/0073705 A1 * 6/2002 Cornell ..... F02D 13/04 60/602
2003/0024503 A1 * 2/2003 Fahringer ..... F02D 41/0007 123/339.16
2005/0015196 A1 * 1/2005 Hawkins ..... F02D 11/107 701/110
2006/0150945 A1 * 7/2006 Adams ..... F02D 13/0276 123/198 D
2007/0111853 A1 * 5/2007 King ..... F02B 37/24 477/109
2008/0262693 A1 * 10/2008 Burkhart ..... B60T 10/00 701/98
2009/0233762 A1 * 9/2009 Choby ..... B60W 30/18109 477/94
2010/0168976 A1 * 7/2010 Andrasko ..... B60W 10/198 701/70
2011/0015038 A1 * 1/2011 Lovell ..... B60T 10/00 477/186
2011/0106388 A1 * 5/2011 Boeckenhoff ..... B60W 10/06 701/70
2011/0276216 A1 * 11/2011 Vaughan ..... B60W 10/04 701/31.4
2012/0197500 A1 * 8/2012 Sujan ..... B60W 50/0097 701/51
2012/0215411 A1 * 8/2012 Seymour ..... B60T 8/885 701/70
2013/0060453 A1 * 3/2013 McDonald ..... F02D 13/06 701/112
2014/0214295 A1 * 7/2014 Elliott ..... E02F 9/2253 701/65
2014/0244116 A1 * 8/2014 Andrasko ..... B60W 10/198 701/48
2014/0261314 A1 * 9/2014 Ross ..... F02D 13/0242 123/345
2015/0046052 A1 * 2/2015 Jensen ..... B60T 8/1701 701/70
2017/0044998 A1 * 2/2017 Holub ..... F02D 41/021

* cited by examiner

AUTOMATIC ENGINE BRAKE CONTROL SYSTEMS AND METHODS

RELATED APPLICATIONS

The present disclosure is related to and claims priority to U.S. Provisional Application No. 62/595,984, entitled "AUTOMATIC ENGINE BRAKE CONTROL SYSTEMS AND METHODS," filed on Dec. 7, 2017, the entire disclosure of which is hereby expressly incorporated herein by reference.

FIELD OF THE DISCLOSURE

The present disclosure generally relates to vehicle control systems for brake control devices, and more specifically to engine brake activation systems for performing automatic activation of a variable engine brake.

BACKGROUND OF THE DISCLOSURE

A conventional braking system and method for large vehicles, such as tractor trailer vehicles, is assisted by devices known as engine brakes or engine compression brakes. For example, an engine brake system utilizes an energy required to compress air into cylinders of an engine to brake the vehicle. A drag put on a drive line by the engine when placed in a compression braking mode can operate to slow the vehicle more rapidly, when used in conjunction with disc or drum brakes of the vehicle.

During over-speed conditions of the vehicle, an automated engine brake system can be activated to decelerate the vehicle. Conventional engine braking methods prevent excessive wear on friction brakes and reduce the risk of overheating the friction brakes by avoiding direct contacts between brake pads and corresponding rotors. Further, fuel injection engines typically cease to supply fuel into the engine while engine braking, known as deceleration fuel cut-off. However, such fuel cut-off does not protect the engine from the over-speed conditions at certain events, such as while traveling on a downhill grade path. Down gear-shifting performed during engine braking further increases an engine speed and can cause damage to other engine components.

Accordingly, it is desirable to develop a control system that improves operational limits of automatic engine brake systems and prevents engine damage cause by over-speed conditions.

SUMMARY OF THE DISCLOSURE

In one embodiment, the present disclosure provides a system for controlling operation of an engine brake system of an engine in a vehicle. The system includes a controller including an over-speed condition detection unit and an operation mode transition unit. The over-speed condition detection unit is configured to detect an over-speed condition based on a current engine speed and a fuel cut limit speed, the fuel cut limit speed being a predetermined engine speed at which fuel supplied to the engine is suspended. The operation mode transition unit is configured to control the operation of the engine brake system by transitioning the controller between a plurality of brake operation modes based on at least one transition parameter.

In one example, the system further includes a vehicle condition monitoring unit configured to monitor an operational state of the vehicle while the controller is activated.

In another example, the over-speed condition detection unit determines that the over-speed condition is satisfied when the current engine speed is greater than the fuel cut limit speed, and that the over-speed condition is not satisfied when the current engine speed is less than or equal to the fuel cut limit speed. In a variation, the over-speed condition detection unit is configured to detect the over-speed condition based on an activation state of the engine brake system.

In yet another example, the at least one transition parameter includes a first flag representing a first condition indicating whether the over-speed condition is satisfied. In a variation, the at least one transition parameter includes a second flag representing a second condition indicating whether the engine brake system is manually activated. In a further variation, the at least one transition parameter includes a third flag representing a third condition indicating whether the current engine speed is increasing in real time. In another variation, the at least one transition parameter includes a fourth flag indicating whether the current engine speed is decreasing in real time. In yet another variation, the at least one transition parameter includes a fifth flag indicating whether the engine brake system is currently active. In still another variation, the at least one transition parameter includes a sixth flag indicating whether a timer is expired.

In another embodiment, a system is provided for controlling operation of an engine brake system of an engine in a vehicle, using at least one processor. The system includes an initialization unit configured to generate an initialization signal based on a determination of whether the engine satisfies a minimum operation condition. Further, the system includes an over-speed condition detection unit configured to be initiated based on the initialization signal and to detect an over-speed condition based on a current engine speed and a fuel cut limit speed, the fuel cut limit speed being a predetermined engine speed at which fuel supplied to the engine is suspended, and an operation mode transition unit configured to control the operation of the engine brake system by transitioning the at least one processor between a plurality of brake operation modes based on a transition parameter.

In one example, the over-speed condition detection unit determines that the over-speed condition is satisfied when the current engine speed is greater than the fuel cut limit speed, and that the over-speed condition is not satisfied when the current engine speed is less than or equal to the fuel cut limit speed.

In another example, the plurality of brake operation modes includes at least two of: a normal engine operation mode, a hold mode, an engine brake activation mode, an engine brake deactivation mode, and a throttle operation mode.

In yet another example, the transition parameter includes at least one of: a first flag representing a first condition indicating whether the over-speed condition is satisfied; a second flag representing a second condition indicating whether the engine brake system is manually activated; a third flag representing a third condition indicating whether the current engine speed is increasing in real time; a fourth flag indicating whether the current engine speed is decreasing in real time; a fifth flag indicating whether the engine brake system is currently active; and a sixth flag indicating whether a timer is expired.

In yet another embodiment, a method of controlling operation of an engine brake system of an engine in a vehicle is provided. The method includes receiving, using at least one processor, a signal representative of a current engine speed from an engine speed sensor; detecting, using the at least one processor, an over-speed condition based on the current engine speed and a fuel cut limit speed, the fuel cut limit speed being a predetermined engine speed at which fuel supplied to the engine is suspended; and controlling, using the at least one processor, the operation of the engine brake system by transitioning the at least one processor between a plurality of brake operation modes based on a transition parameter.

In one example, the method further includes displaying data related to the operation of the engine brake system on a display device in real-time.

In another example, the method further includes determining that the over-speed condition is satisfied when the current engine speed is greater than the fuel cut limit speed, and that the over-speed condition is not satisfied when the current engine speed is less than or equal to the fuel cut limit speed.

In yet another example, the method further includes detecting the over-speed condition based on a current vehicle speed.

In still another example, the method further includes including, in the transition parameter, at least one of: a first flag representing a first condition indicating whether the over-speed condition is satisfied; a second flag representing a second condition indicating whether the engine brake system is manually activated; a third flag representing a third condition indicating whether the current engine speed is increasing in real time; a fourth flag indicating whether the current engine speed is decreasing in real time; a fifth flag indicating whether the engine brake system is currently active; and a sixth flag indicating whether a timer is expired.

In still yet another example, the method further includes detecting a change in a road grade on which the vehicle is traveling and pre-emptively activating the engine brake system in anticipation of the change in the road grade. While multiple embodiments are disclosed, still other embodiments of the present disclosure will become apparent to those skilled in the art from the following detailed description, which shows and describes illustrative embodiments of the present disclosure. Accordingly, the drawings and detailed description are to be regarded as illustrative in nature and not restrictive.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

Figure 1:
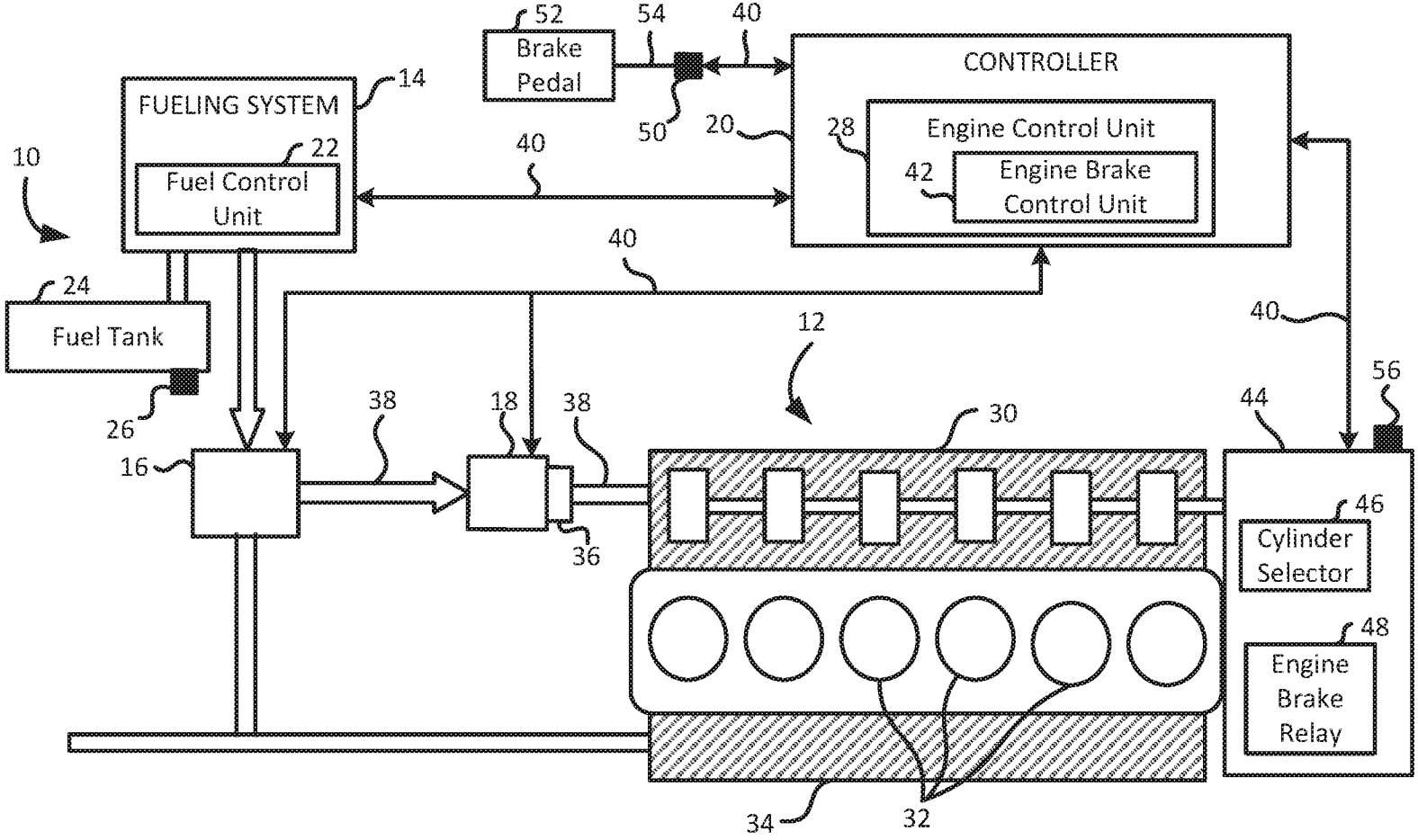
FIG. 1 is a schematic illustration of an exemplary internal combustion engine system having an engine brake control unit in accordance with embodiments of the present disclosure.

While the present disclosure is amenable to various modifications and alternative forms, specific embodiments have been shown by way of example in the drawings and are described in detail below. The intention, however, is not to limit the present disclosure to the particular embodiments described. On the contrary, the present disclosure is intended to cover all modifications, equivalents, and alternatives falling within the scope of the present disclosure as defined by the appended claims.

DETAILED DESCRIPTION OF EMBODIMENTS

In the following detailed description, reference is made to the accompanying drawings which form a part hereof, and in which is shown by way of illustration specific embodiments in which the present disclosure is practiced. These embodiments are described in sufficient detail to enable those skilled in the art to practice the present disclosure, and it is to be understood that other embodiments can be utilized and that structural changes can be made without departing from the scope of the present disclosure. Therefore, the following detailed description is not to be taken in a limiting sense, and the scope of the present disclosure is defined by the appended claims and their equivalents.

FIG. 1 shows an exemplary internal combustion engine system 10 of a vehicle including an engine 12, a fueling system 14 including a fuel mixer 16 to mix air with fuel and/or with a recirculated air/fuel mixture. In this example, engine 12 is a fuel engine operated by liquid fuel, such as gasoline, compressed natural gas (CNG), liquefied natural gas (LNG), or the like. Other suitable types of engines using gaseous fuels, such as liquefied hydrogen, propane, or other pressurized fuels, are also contemplated to suit different applications. In one embodiment, such as in a gasoline engine, the fuel is directly injected into cylinders 32 or port fuel injected into intake manifold 30. In another embodiment, the air/fuel mixture is supplied to a fuel metering assembly or throttle 18, or back to fuel mixer system 16 for mixing with fresh air and fuel in accordance with a signal provided by a controller 20.

As used herein, "gas charge" refers to gases supplied to fuel metering assembly 18. In this example, fueling system 14 includes a fuel control unit 22 configured to control an amount of fuel supplied from a fuel tank 24 to fuel mixer 16. A fuel tank pressure sensor 26 monitors a pressure level inside fuel tank 24, and reports a pressure reading to an engine control unit (ECU) 28. Engine 12 includes intake manifold 30 receiving the gas charge from fuel metering assembly 18, cylinders 32 to combust the gas charge, and exhaust manifold 34 receiving combustion gases from cylinders 32 and supplying the combusted gases to a charging subsystem as desired. In one embodiment, fuel metering assembly 18 includes a fuel shut-off valve, a pressure compensating by-pass valve, and the like. In this example, an intake throttle valve 36 is disposed at an entrance of intake manifold 30 to regulate an amount of fuel or air entering engine 12. However, other configurations of intake throttle valve 36, such as placing intake throttle valve 36 in a throttle body or a carburetor, are also contemplated to suit different applications, such as Port Fuel Injection (PFI) and Direct Injection (DI) fuel injectors. Variable open and closed positions of intake throttle valve 36 are controlled by ECU 28.

Controller 20 includes ECU 28 operable to produce control signals on any one or more of signal paths 40 to control the operation of one or more corresponding suitably positioned engine components, such as fueling system 14. One or more engine systems related the engine load, such as engine torque or horsepower, and other engine parameters, such as an engine speed or revolution per minute (RPM), are also controlled by ECU 28 for regulating operation of engine system 10. ECU 28 is in communication with a controller area network (CAN) or other serial bus systems for communicating with various components and sensors on engine 12 and/or within the vehicle.

ECU 28 includes an engine brake control unit 42 configured to control operation of an engine brake system 44. In one embodiment, engine brake system 44 includes a cylinder selector 46 and an engine brake relay 48. For example, when engine brake relay 48 is energized cylinder selector 46 is activated for initiating compression braking of cylinders 32. A variety of input signals are supplied to digital and analog inputs of ECU 28, which inputs correspond to operating conditions of the vehicle. For example, a switch 50 is operatively coupled to a brake pedal 52 via linkage 54, and ECU 28 is notified of the activation of brake pedal 52 via signal paths 40. In embodiments, engine brake system 44 is activated automatically by engine brake control unit 42, or manually by an activation device 56, such as a button depressible by a user. Conversely, deactivation of engine brake system 44 is achieved automatically by engine brake control unit 42, or manually by activation device 56. Other suitable methods are also contemplated, such as depressing brake pedal 52 for deactivating engine brake system 44. In another example, brake pedal 52 can be used to deactivate or activate the compression brake depending on vehicle operating conditions.

Figure 2:
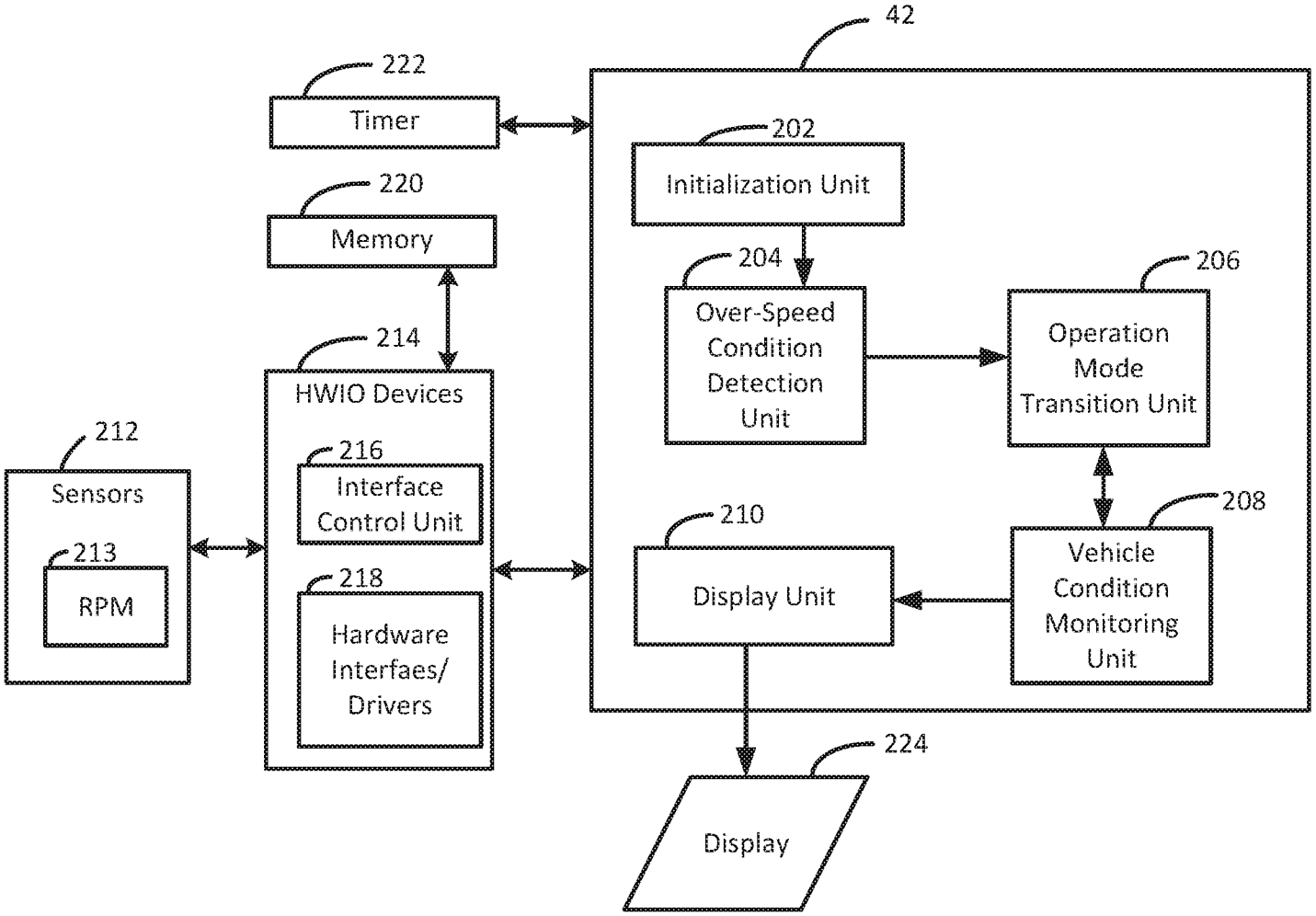
FIG. 2 is a functional block diagram of the engine brake control unit of FIG. 1 featuring related units and components in accordance with embodiments of the present disclosure.

FIG. 2 shows an exemplary engine brake control unit 42 featuring its sub-units in accordance with embodiments of the present disclosure. In this example, engine brake control unit 42 includes an initialization unit 202, an over-speed condition detection unit 204, an operation mode transition unit 206, a vehicle condition monitoring unit 208, and a display unit 210. Initialization unit 202 receives signals from sensors 212, such as an engine speed sensor 213, via hardware input/output (HWIO) devices 214. In one example, HWIO devices 214 include an interface control unit 216 and hardware interfaces/drivers 218. Interface control unit 216 provides an interface between the units 202-210, and hardware interfaces/drivers 218. Hardware interfaces/drivers 218 control operation of, for example, a camshaft phaser position sensor, a pressure sensor, engine speed sensor 213, and other engine system components. Other engine system components include ignition coils, spark plugs, throttle valves, solenoids, etc. Hardware interface/drivers 218 also receive sensor signals, which are communicated to the control unit 42. Memory 220 is operatively coupled to HWIO devices 214 to store and retrieve operational data and parameters. Memory 220 can be part of ECU 28 or separate from ECU 28.

As an example only, interface control unit 216 is communicably coupled to controller 20, and provides commands to controller 20 corresponding to a desired position of one or more valves, provides commands to controller 20 wherein at least one of the commands causes controller 20 to modify at least one of: an operational parameter of engine 12 and a mode of operation of engine 12, and receives one or more parameter signals corresponding to an operational parameter of engine 12. Although sub-units 202-210 are shown separately for illustration purposes, any combinations of sub-units are also contemplated to suit different applications.

In this example, sensors 212 include fuel tank pressure sensor 26 and engine speed sensor 213, but other suitable sensors, such as an intake air temperature sensor or a vehicle speed sensor, are contemplated to suit different applications. Initialization unit 202 generates an initialization signal based on the signals from sensors 212 and determines whether to enable over-speed condition detection unit 204 by verifying that various initialization conditions are met. For example, the initialization conditions include ensuring that engine 12 satisfies a minimum operation condition, e.g., engine 12 is operable at a predetermined engine speed for a predetermined time period. When the initialization conditions are met, initialization unit 202 generates and transmits the initialization signal to over-speed condition detection unit 204.

During engine operation, over-speed condition detection unit 204 is configured to detect an over-speed condition based on at least one of: a current engine speed of the vehicle and a fuel cut limit speed. In one example, the fuel cut limit speed can be set at 3800 RPM. For example, as the engine speed increases, engine brake control unit 42 can selectively stop fueling and activate engine brake system 44 at 3800 RPM. However, as the engine speed decreases, engine brake control unit 42 can turn off engine brake system 44 and fuel back on at 3600 RPM to provide a hysteresis margin from the 3800 RPM limit.

In another embodiment, over-speed condition detection unit 204 is configured to detect the over-speed condition based on a current vehicle speed. In one example, when the current engine speed is greater than the fuel cut limit speed, the over-speed condition is detected. The fuel cut limit speed refers to a predetermined engine speed at which the fuel supplied to engine 12 is suspended or cut off, e.g., by the fuel shut-off valve of fuel metering assembly 18. In another example, the over-speed condition is detected based on an activation state of engine brake system 44. For example, when engine brake system 44 is activated by depressing activation device 56, the over-speed condition is detected. In one embodiment, over-speed condition detection unit 204 is configured to determine a current location of the vehicle and detect a change in a road grade on which the vehicle is traveling. For example, when a downhill grade is detected by over-speed condition detection unit 204, engine brake system 44 can be automatically and pre-emptively activated by engine brake control unit 42 in anticipation of the upcoming downhill grade on the road.

Operation mode transition unit 206 is configured to perform a control operation on engine 12 by transitioning engine brake control unit 42 between a plurality of brake operation modes based on a transition parameter. Detailed descriptions of the transition parameter are provided below in paragraphs related to FIG. 3. In one embodiment, the plurality of brake operation modes include a normal engine operation mode that refers to a condition in which engine 12 is operated without activating engine brake system 44. For example, while the over-speed condition is undetected, engine brake control unit 42 is in the normal engine operation mode. However, the plurality of brake operation modes includes other types of modes. For example, operation mode transition unit 206 transitions engine brake control unit 42 from the normal engine operation mode to a hold mode when the over-speed condition is detected. During the hold mode, engine brake system 44 remains deactivated to avoid actuating compressing brake system 44 prematurely. Detailed transitioning steps regarding the plurality of brake operation modes are described below in paragraphs related to FIG. 3.

Vehicle condition monitoring unit 208 is configured to monitor an operational state of the vehicle while engine brake control unit 42 is activated. In one embodiment, vehicle condition monitoring unit 208 monitors an engine speed of the vehicle for a predetermined time period using a timer 222. For example, when the engine speed is less than the fuel cut limit speed before timer 222 expires, vehicle condition monitoring unit 208 instructs engine brake control unit 42 to transition to the normal engine operation mode because activation of engine brake system 44 is unnecessary. However, when the engine speed is greater than the fuel cut limit speed after timer 222 expires, vehicle condition monitoring unit 208 instructs engine brake control unit 42 to transition to one of the plurality of brake operation modes.

Display unit 210 is configured to display data related to the operation of engine 12. In one example, display unit 210 receives and outputs data generated by engine brake control unit 42 for display, e.g., on a display device 224. For example, the data related to the engine brake operation is presented on a screen or printed on a paper for viewing in real-time. For example, a smart display system is used to display textual or graphical illustrations representing one or more of the plurality of brake operation modes. In some embodiments, a user is notified by an alert or warning message, for example, using an audible or illuminating device available in the vehicle. Other suitable presentation methods are contemplated to suit the application. As described above, it is advantageous that engine brake control unit 42 provides control logic that selectively controls an engine speed, reduces a time period in which engine 12 is operated above the fuel cut limit speed, reduces engine components damage, and executes automatic engine protection features.

Figure 3:
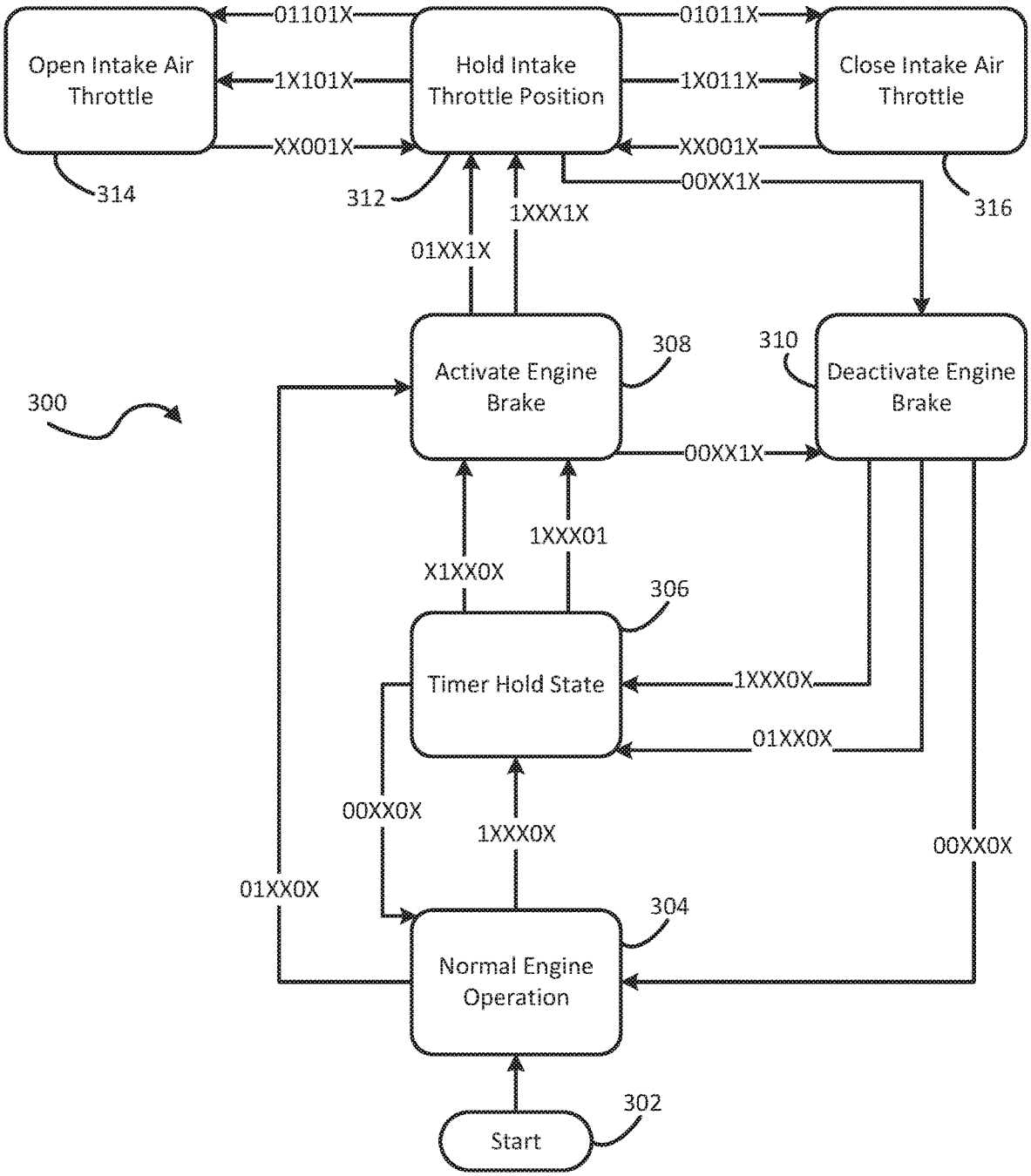
FIG. 3 is a flowchart illustrating one example of a method of performing an automatic engine brake control operation of a vehicle in accordance with embodiments of the present disclosure.

FIG. 3 shows an exemplary method 300 of performing automatic engine brake operation of a vehicle in accordance with embodiments of the present disclosure. It will be described with reference to FIGS. 1 and 2. However, any suitable structure can be employed. Although sub-blocks 302-316 are illustrated, other suitable sub-blocks can be employed to suit different applications. It should be understood that the blocks within the method can be modified and executed in a different order or sequence without altering the principles of the present disclosure.

In FIG. 3, a six-bit register stored in memory 220 is used as a transition parameter for indicating an operational state of the vehicle. In embodiments, vehicle condition monitoring unit 208 detects any change in the operational state of the vehicle that causes a modification of the transition parameter. In this example, a first bit of the transition parameter is a first flag representing a first condition (i.e., the over-speed condition) indicating whether a current engine speed (e.g., RPM) is greater than a fuel cut limit speed. A second bit of the transition parameter is a second flag representing a second condition indicating whether engine brake system 44 is manually activated, e.g., using activation device 56. A third bit of the transition parameter is a third flag representing a third condition indicating whether a current engine speed is increasing in real time. For example, an engine speed rate is a positive number.

A fourth bit of the transition parameter is a fourth flag representing a fourth condition indicating whether a current engine speed is decreasing in real time. For example, the engine speed rate is a negative number. A fifth bit of the transition parameter is a fifth flag representing a fifth condition indicating whether engine brake system 44 is currently active. In one example, engine brake system 44 is activated after the hold mode when the current engine speed is greater than the fuel cut limit speed. In another example, engine brake system 44 is activated when activation device 56 is manually depressed bypassing the hold mode. A sixth bit of the transition parameter is a sixth flag representing a sixth condition indicating whether timer 222 is expired. Although the six-bit register having six flags are shown, a single transition parameter representative of one or more flags is also contemplated to suit different applications.

Each flag includes a first value of "1," a second value of "0," and a third value of "X," wherein the first value indicates "YES," the second value indicates "NO," and the third value indicates "DON'T CARE." For example, when the sixth flag is "1," timer 222 is expired, when the sixth flag is "0," timer 222 is still running, and when the sixth flag is "X," the value of sixth flag is irrelevant to operation of engine brake control unit 42.

In FIG. 3, the method starts automatically at block 302 when engine 12 is started and remains operational during operation of engine 12. In operation, at block 304, initialization unit 202 receives signals from sensors 212, such as engine speed sensor 213, via HWIO devices 214, and transmits the signals to over-speed condition detection unit 204 for determining whether an over-speed condition is satisfied. At block 304, when the current engine speed is greater than the fuel cut limit speed, and engine brake system 44 is activated (e.g., transition parameter="1XXX0X"), control proceeds to block 306. In another example, when activation device 56 is depressed even though the current engine speed is less than or equal to the fuel cut limit speed or engine brake system 44 is inactivated (e.g., transition parameter="01XX0X"), control proceeds to block 308.

At block 306, engine brake control unit 42 transitions to the hold mode. However, when the current engine speed is less than or equal to the fuel cut limit speed during the predetermined time period measured by timer 222, and engine brake system 44 is not manually activated and is not currently activated (e.g., transition parameter="00XX0X"), control proceeds to block 304 bypassing the hold mode. In one example, if the engine speed reduces below the fuel cut limit speed before timer 222 expires, engine 12 returns to the normal engine operation mode. In certain cases, however, such as during transient events (e.g., gearshift events on a steep downhill grade road), if timer 222 expires and the engine speed is not reduced, engine brake system 44 is automatically activated. When activation device 56 is depressed and engine brake system 44 is inactive (e.g., transition parameter="X1XX0X"), control proceeds to block 308. Also, when the over-speed condition is satisfied after timer 222 is expired, and engine brake system 44 is inactive (e.g., transition parameter="1XXX01"), control proceeds to block 308. At block 308, engine brake control unit 42 transitions to an engine brake activation mode, and automatically activates engine brake system 44. However, before the activation of engine brake system 44 is completed, when the over-speed condition is no longer satisfied and engine brake system 44 is not yet activated (e.g., transition parameter="00XX1X"), control proceeds to block 310. When the over-speed condition is still satisfied and engine brake system 44 is currently active (e.g., transition parameter="1XXX1X"), then control proceeds to block 312. Although the over-speed condition is not satisfied, when activation device 56 is depressed and engine brake system 44 is active (e.g., transition parameter="01XX1X"), control proceeds to block 312.

At block 310, engine brake control unit 42 transitions to an engine brake deactivation mode, and automatically deactivates engine brake system 44. However, during the brake deactivation mode, when the over-speed condition is satisfied again and engine brake system 44 is inactive (e.g., transition parameter="1XXX0X"), control returns to block 306. Also, even if the over-speed condition is not satisfied, when activation device 56 is depressed and engine brake system 44 is inactive (e.g., transition parameter="01XX0X"), control returns to block 306. When the over-speed condition is not satisfied and engine brake system 44 is not manually activated (e.g., transition parameter="00XX0X"), control returns to block 304.

At block 312, engine brake control unit 42 transitions to a throttle operation mode, and maintains a current throttle position of intake throttle valve 36 for a predetermined time period. Engine brake control unit 42 is configured to control operation of throttle 18 and intake throttle valve 36 based on the transition parameter. In this example, throttle 18 and intake throttle valve 36 are used to control engine brake system 44. In one example, during the throttle operation mode, when the over-speed condition is not satisfied, but engine brake system 44 is manually activated and the current engine speed is increasing (e.g., due to a downhill grade; and transition parameter="01101X"), control proceeds to block 314. Also, when the over-speed condition persists during the throttle operation mode, and the current engine speed is increasing and engine brake system 44 is currently active (e.g., transition parameter="1X101X"), control proceeds to block 314.

In another example, during the throttle operation mode, when the over-speed condition is not satisfied, but engine brake system 44 is manually activated and the current engine speed is decreasing (e.g., due to an uphill grade; and transition parameter="01011X"), control proceeds to block 316. Also, when the over-speed condition persists during the throttle operation mode, and the current engine speed is decreasing and engine brake system 44 is currently active (e.g., transition parameter="1X011X"), control proceeds to block 316. However, at block 312, when the over-speed condition is not satisfied and engine brake system 44 is not manually activated (e.g., transition parameter="00XX1X"), control proceeds to block 310.

At block 314, intake throttle valve 36 is variably opened to increase an intake air amount into engine 12 for generating a greater amount of braking torque. When the current engine speed is at a constant speed (e.g., neither increasing nor decreasing at a predetermined rate for a predetermined time period) and engine brake system 44 is active (e.g., transition parameter="XX001X"), control proceeds from block 314 to block 312. Conversely, at block 316, intake throttle valve 36 is variably closed to decrease the intake air amount into engine 12 for generating a lesser amount of braking torque. In one example, while the vehicle is traveling downhill, coasting of the vehicle can be achieved by decreasing an intake fuel amount for facilitating fuel economy. In another example, during the engine brake activation mode, engine 12 may not be fueling, then the braking torque can be reduced by reducing an air flow through engine 12. When the current engine speed is at the constant speed and engine brake system 44 is active (e.g., transition parameter="XX001X"), control proceeds from block 316 to block 312.

Embodiments of the present disclosure are described above by way of example only, with reference to the accompanying drawings. Further, the previous description is merely exemplary in nature and is in no way intended to limit the disclosure, its application, or uses. As used herein, the term "unit" refers to, be part of, or include an Application Specific Integrated Circuit (ASIC), an electronic circuit, a processor or microprocessor (shared, dedicated, or group) and/or memory (shared, dedicated, or group) that executes one or more software or firmware programs, a combinational logic circuit, and/or other suitable components that provide the described functionality. Thus, while this disclosure includes particular examples and arrangements of the units, the scope of the present system should not be so limited since other modifications will become apparent to the skilled practitioner.

Furthermore, while the above description describes hardware in the form of a processor executing code, hardware in the form of a state machine, or dedicated logic capable of producing the same effect, other structures are also contemplated. Although the sub-units 202-210 are illustrated as children units subordinate of the parent unit 42, each sub-unit can be operated as a separate unit from ECU 28, and other suitable combinations of sub-units are contemplated to suit different applications. Also, although the units 202-210 are illustratively depicted as separate units, the functions and capabilities of each unit can be implemented, combined, and used in conjunction with/into any unit or any combination of units to suit different applications.

In further embodiments, although engine 12 is illustrated as a gaseous fuel engine operated by liquid fuel, the present disclosure, such as engine brake control unit 42, can be applied to any internal combustion engines using fossil fuels like natural gas or petroleum products such as gasoline, diesel fuel, fuel oil, or the like. Moreover, other renewable fuels, such as biodiesel for compression ignition engines and bioethanol or methanol for spark ignition engines can utilize the present disclosure. It is also contemplated that the present disclosure is similarly applicable to battery electric vehicles (BEVs) operated by an electric vehicle battery or traction battery. Other suitable types of electric vehicles, such as hybrid vehicles, can utilize the present disclosure. Further, any vehicle having a reciprocating engine can utilize the present disclosure. Any secondary or rechargeable battery operated vehicles can also implement the present disclosure for the engine brake operation.

It is to be understood that the above description is intended to be illustrative, and not restrictive. Many other embodiments will be apparent to those of skill in the art upon reading and understanding the above description. For example, it is contemplated that features described in association with one embodiment are optionally employed in addition or as an alternative to features described in associate with another embodiment. The scope of the present disclosure should, therefore, be determined with reference to the appended claims, along with the full scope of equivalents to which such claims are entitled.

What is claimed is:

1. A system for controlling operation of an engine brake system of an engine in a vehicle comprising:

a controller including an over-speed condition detection unit and an operation mode transition unit;

the over-speed condition detection unit configured to detect an over-speed condition based on at least one of: a current engine speed and a fuel cut limit speed, the fuel cut limit speed being a predetermined engine speed at which fuel supplied to the engine is suspended;

the operation mode transition unit configured to control the operation of the engine brake system by transitioning the controller between a plurality of brake operation modes based on at least one transition parameter; and wherein the controller is configured to control an operation of an intake throttle valve to transition to one of the plurality of brake operation modes to increase an amount of intake air into the engine in response to a detection of the over-speed condition and an increase in the current engine speed and to control the operation of the intake throttle valve to transition to another one of the plurality of brake operation modes to decrease the amount of intake air into the engine in response to the detection of the over-speed condition and a decrease in the current engine speed.

2. The system of claim 1, further comprising a vehicle condition monitoring unit configured to monitor an operational state of the vehicle while the controller is activated.

3. The system of claim 1, wherein the over-speed condition detection unit determines that the over-speed condition is satisfied when the current engine speed is greater than the fuel cut limit speed, and that the over-speed condition is not satisfied when the current engine speed is less than or equal to the fuel cut limit speed.

4. The system of claim 3, wherein the over-speed condition detection unit is configured to detect the over-speed condition based on an activation state of the engine brake system.

5. The system of claim 1, wherein the at least one transition parameter includes a first flag representing a first condition indicating whether the over-speed condition is satisfied.

6. The system of claim 1, wherein the at least one transition parameter includes a second flag representing a second condition indicating whether the engine brake system is manually activated.

7. The system of claim 1, wherein the at least one transition parameter includes a third flag representing a third condition indicating whether the current engine speed is increasing in real-time.

8. The system of claim 1, wherein the at least one transition parameter includes a fourth flag indicating whether the current engine speed is decreasing in real-time.

9. The system of claim 1, wherein the at least one transition parameter includes a fifth flag indicating whether the engine brake system is currently active.

10. The system of claim 1, wherein the at least one transition parameter includes a sixth flag indicating whether a timer is expired.

11. A system for controlling operation of an engine brake system of an engine in a vehicle, using at least one processor, comprising:

an initialization unit configured to generate an initialization signal based on a determination of whether the engine satisfies a minimum operation condition;

an over-speed condition detection unit configured to be initiated based on the initialization signal and to detect an over-speed condition based on at least one of: a current engine speed and a fuel cut limit speed, the fuel cut limit speed being a predetermined engine speed at which fuel supplied to the engine is suspended;

an operation mode transition unit configured to control the operation of the engine brake system by transitioning the at least one processor between a plurality of brake operation modes based on a transition parameter; and wherein the at least one processor is configured to control an operation of an intake throttle valve to transition to one of the plurality of brake operation modes to increase an amount of intake air into the engine in response to a detection of the over-speed condition and an increase in the current engine speed and to control the operation of the intake throttle valve to transition to another one of the plurality of brake operation modes to variably decrease the amount of intake air into the engine in response to the detection of the over-speed condition and a decrease in the current engine speed.

12. The system of claim 11, wherein the over-speed condition detection unit determines that the over-speed condition is satisfied when the current engine speed is greater than the fuel cut limit speed, and that the over-speed condition is not satisfied when the current engine speed is less than or equal to the fuel cut limit speed.

13. The system of claim 11, wherein the plurality of brake operation modes includes at least two of: a normal engine operation mode, a hold mode, an engine brake activation mode, an engine brake deactivation mode, and a throttle operation mode.

14. The system of claim 11, wherein the transition parameter includes at least one of: a first flag representing a first condition indicating whether the over-speed condition is satisfied; a second flag representing a second condition indicating whether the engine brake system is manually activated; a third flag representing a third condition indicating whether the current engine speed is increasing in real-time; a fourth flag indicating whether the current engine speed is decreasing in real-time; a fifth flag indicating whether the engine brake system is currently active; and a sixth flag indicating whether a timer is expired.

15. A method of controlling operation of an engine brake system of an engine in a vehicle, comprising:

receiving, using at least one processor, a signal representative of a current engine speed from an engine speed sensor;

detecting, using an over-speed condition detection unit of the at least one processor, an over-speed condition based on at least one of: the current engine speed and a fuel cut limit speed, the fuel cut limit speed being a predetermined engine speed at which fuel supplied to the engine is suspended;

controlling, using an operation mode transition unit of the at least one processor, the operation of the engine brake system by transitioning the at least one processor between a plurality of brake operation modes based on a transition parameter;

controlling, using the operation mode transition unit and in response to detecting, using the over-speed condition detection unit, the over-speed condition and an increase in the current engine speed, an operation of an intake throttle valve to increase an amount of intake air into the engine; and controlling, using the operation mode transition unit and in response to detecting, using the over-speed condition detection unit, the over-speed condition and a decrease in the current engine speed, the operation of the intake throttle valve to decrease the amount of intake air into the engine.

16. The method of claim 15, further comprising displaying data related to the operation of the engine brake system on a display device in real-time.

17. The method of claim 15, further comprising determining that the over-speed condition is satisfied when the current engine speed is greater than the fuel cut limit speed, and that the over-speed condition is not satisfied when the current engine speed is less than or equal to the fuel cut limit speed.

18. The method of claim 15, further comprising detecting the over-speed condition based on a current vehicle speed.

19. The method of claim 15, further comprising including, in the transition parameter, at least one of: a first flag representing a first condition indicating whether the over-speed condition is satisfied; a second flag representing a second condition indicating whether the engine brake system is manually activated; a third flag representing a third condition indicating whether the current engine speed is increasing in real-time; a fourth flag indicating whether the current engine speed is decreasing in real-time; a fifth flag indicating whether the engine brake system is currently active; and a sixth flag indicating whether a timer is expired.

20. The method of claim 15, further comprising detecting a change in a road grade on which the vehicle is traveling and pre-emptively activating the engine brake system in anticipation of the change in the road grade.

* * * * *